United States Patent [19]

Henne et al.

[11] Patent Number: 4,694,994

[45] Date of Patent: Sep. 22, 1987

[54] ROLLER MILL

[75] Inventors: Heinrich Henne, Ennigerloh; Gotthardt Blasczyk; Hubert Eickholt, both of Beckum; Ludger Lohnherr, Oelde, all of Fed. Rep. of Germany

[73] Assignee: Krupp Polysius AG, Beckum, Fed. Rep. of Germany

[21] Appl. No.: 759,836

[22] Filed: Jul. 29, 1985

[30] Foreign Application Priority Data

Aug. 31, 1984 [DE] Fed. Rep. of Germany ... 8425837[U]

[51] Int. Cl.[4] ..... B02C 15/00; B02C 23/32

[52] U.S. Cl. ..... 241/79.1; 241/119

[58] Field of Search ..... 241/117–121, 241/80, 97, 79.1

[56] References Cited

U.S. PATENT DOCUMENTS 4,597,537 7/1986 Misaka et al. ..... 241/119 X

FOREIGN PATENT DOCUMENTS 2019005 11/1971 Fed. Rep. of Germany ..... 241/79.1

1938772 12/1980 Fed. Rep. of Germany .

*Primary Examiner*—Mark Rosenbaum

*Attorney, Agent, or Firm*—Learman & McCulloch

[57] ABSTRACT

The invention relates to a roller mill with a sifter arranged above it which is provided with a deflecting rotor and an adjustable ring of guide vanes. Such a construction is distinguished by a particularly high degree of separation.

14 Claims, 1 Drawing Figure

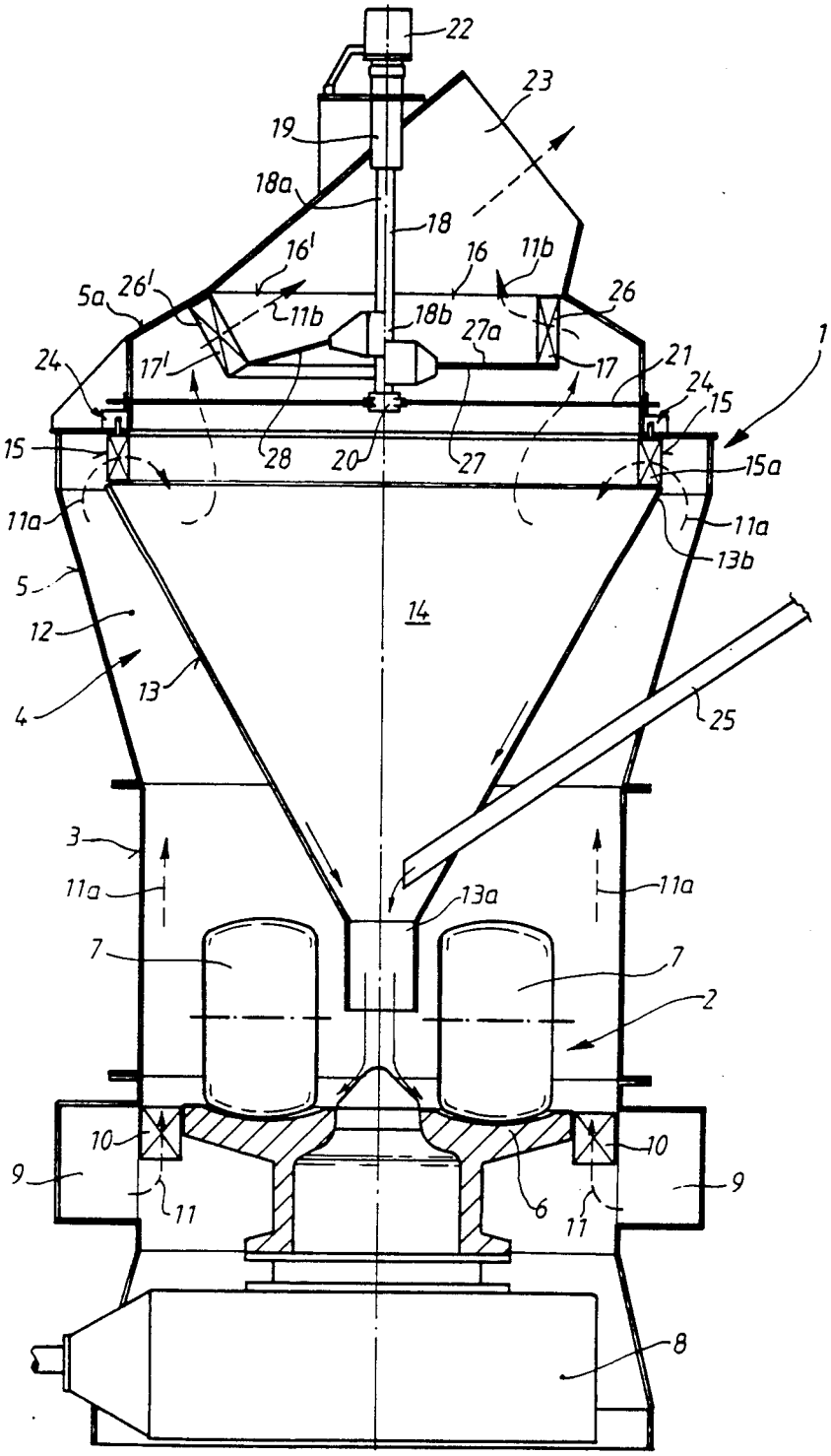
22
23
19
18a
18
16'
16
11b
5a
26'
26
11b
18b
27a
24
17'
17
21
24
15
1
15
28
20
27
15a
11a
11a
13b
5
14
12
13
4
25
3
11a
13a
11a
7
7
2
10
10
9
9
11
6
11
8

ROLLER MILL

The invention relates to a roller mill of the kind having grinding rollers in engagement with a grinding plate.

BACKGROUND OF THE INVENTION

A roller mill of the type to which the invention relates is known from German Auslegeschrift No. 19 38 722. In this roller mill a sifter part is arranged above a grinding part containing a grinding face with roller bodies rolling on it, and the sifting chamber of the sifter part is in flow connection with the grinding part, so that an air stream coming from the grinding part and charged with comminuted material passes through a ring of guide vanes provided on the upper outer periphery of the sifting chamber (as a connecting passage) and into the sifting chamber. The material for grinding which has not yet been sufficiently comminuted (coarse material) is to be separated off in this sifting chamber and returned to the grinding face from the hopper arranged at the bottom. In addition, a fan wheel which rotates about a vertical shaft is arranged in the region above the ring of guide vanes and the sifted air stream charged with fine material and flowing upwards to the exhaust pipe passes axially through this fan wheel so that further sifting of the fine material carried upwards with the air stream can be achieved.

SUMMARY OF THE INVENTION

The object of the invention is to improve the known roller mill in such a way that in the sifting of the material for grinding it is possible to achieve an even higher degree of separation, a greater fineness of the finished material and an even more readily adjustable range of grain sizes.

In a roller mill according to the invention the rotating element above the sifting chamber and the ring of guide vanes is constructed in the form of a deflecting rotor so that, the air stream flowing upwards to the exhaust pipe and charged with fine material is guided—in contrast to the known construction described above—not axially but at first approximately radially from the exterior towards the interior through the rotating element. In the course of this some of the particles of material which are too coarse but which are still contained in the fine material are subjected to a rebound effect and some to a centrifugal effect, as a result of which they drop to the lower part of the sifting chamber and thus into the coarse material hopper and from there return to the grinding face for further comminution. In this way a marked improvement in the further sifting of the fine material (finished material) flowing off with the sifted air stream is achieved in co-operation with the adjustable ring of guide vanes on the upper periphery of the sifting chamber, since when the air stream charged with material for grinding enters the sifting chamber a particularly good preliminary sifting of the material for grinding can already be achieved and thus a relatively high degree of adjustability for the fineness and influencing the range of grain sizes can be achieved. The degree of separation in sifting and the range of fineness in the finished material can be influenced by several advantageous constructions and further developments of the deflecting rotor.

Thus for example the outer peripheral openings of the deflecting rotor can be defined by baffles which are arranged at regular intervals on the periphery, are advantageously constructed like vanes and can be arranged so as to be adjustable; in addition, the deflecting rotor can have at its axially lower end a closed base with holes of adjustable size, its axially upper end being of open construction.

For a particularly favourable co-operation of preliminary sifting and further sifting it is also very advantageous if the ring of guide vanes is arranged on the upper end of the hopper which has the greatest diameter, whilst the deflecting rotor which has a diameter smaller than that of the ring of guide vanes is arranged in a sifter housing part with a reduced diameter located above the ring of guide vanes. This helps the sifted air stream charged with fine material to be guided in a favourable and reliable manner to the openings provided on the outer periphery of the deflecting rotor.

THE DRAWING

A roller mill according to the invention is illustrated in the single drawing figure which has been kept largely schematic and in which the deflecting rotor provided therein is shown in two different embodiments in the right-hand half and the left-hand half of the drawing.

DETAILED DESCRIPTION

The roller mill 1 illustrated in the drawing can for example be a spring roller mill, but naturally other suitable forms of the actual roller mill, e.g. ball ring mill, could also be used.

The roller mill 1 essentially comprises a lower grinding part 2 with a mill housing 3 and a sifter part 4 placed (e.g. flanged) on this grinding part with an outer sifter housing 5.

The grinding part 2 can be equipped in the usual way with an approximately annular grinding member 6 and roller bodies 7 (in this case in the form of spring roller) which move relative to the grinding member 6 and roll on its member. The grinding member 6 is set in rotation by a conventional drive with gears 8.

Air (arrows 11) is introduced into the grinding part 2 of the roller mill from below through an air supply channel 9 provided on the outer periphery of the grinding part 2 and a (lower) ring of guide vanes 10 arranged around the grinding member 6, so that material for grinding falling out from the edge of the grinding member 6 can be conveyed upwards (pneumatically) with this air stream into the sifter part 4.

The sifter part 4 contains an outer annular conveying air passage chamber 12 which is defined externally by the sifter housing 5 and internally essentially by a hopper 13. In the downward direction this hopper 13 defines a sifting chamber 14 which is arranged above the grinding part 2 or grinding member 6 and also has on the outer periphery at the top a ring of guide vanes 15 which forms a connecting passage between the grinding part 2 or the grinding member 6 and the sifting chamber 14 for the air stream (arrow 11*a*) charged with material for grinding. The lower end 13*a* of the coarse material hopper 13 opens centrally above the grinding member 6, and a supply tube 25 coming from outside for fresh material for grinding can also open in this region (inside or outside the lower end 13*a* of the hopper).

A defecting rotor 16 of basket-like construction which has a plurality of openings 17 evenly distributed on its periphery is mounted on the lower end of a vertically aligned rotary shaft 18 and positioned coaxially with and above the ring of guide vanes 15 of the sifting chamber so that all of the air stream (arrows 11*b*) charged with fine material passes through this deflecting rotor 16. As will be explained in greater detail below on the basis of the right-hand and left-hand halves 16 and 16' respectively, this deflecting rotor can be of various constructions. In any case the rotary shaft 18 of the deflecting rotor 16 is mounted at its upper end 18*a* in the sifter housing 5 by means of an outer bearing 19 and is supported at its lower end 18*b* in a lower bearing 20 which is centered and braced in the upper part of the sifter housing 5 by means of radial pull rods 21 which are optionally sprung. The upper end 18*a* of the rotary shaft is also coupled to a drive 22 which is preferably adjustable in its speed.

As can also be seen from the drawing, the ring of guide vanes 15 is located on the upper end 13*b* of the coarse material hopper 13 which has the largest diameter, and the deflecting rotor 16 which is smaller in diameter than the ring of guide vanes 15 is arranged in an upper part 5*a* of the sifter housing which is located above the ring of guide vanes 15 and has a smaller diameter than the latter. The annular space surrounding the outer periphery of the deflecting rotor 16 is shaped by this upper part 5*a* of the sifter housing in such a way that the air stream (arrows 11*b*) charged with fine material can be reliably delivered to the outer peripheral openings 17 of the deflecting rotor.

The axially upper end of the deflecting rotor 16 is in each case of open construction and is in open flow connection with the exhaust pipe 23 which is constructed on the upper part 5*a* of the sifter housing.

The guide vanes 15*a* of the ring of guide vanes 15 for the sifting chamber are preferably adjustable in their blade angle, and for this purpose the guide vanes are connected to a common adjusting means 24 arranged on the outside of the sifter housing 5.

As has already been indicated above, the deflecting rotor can be of various constructions.

In the construction illustrated in the right-hand half of the drawing the outer periphery of the deflecting rotor 16 is approximately cylindrical in shape. The outer peripheral openings are defined by baffles of vane-like construction arranged at regular intervals on the periphery which are of similar construction to the guide vanes 15*a* of the ring of guide vanes 15 and can also preferably be constructed so as to be adjustable in their blade angle. Whereas—as already mentioned—the axially upper end of the deflecting rotor 16 is of open construction, the axially lower end can be completely closed at the base or—as indicated in the right-hand half of the drawings—can have openings 27*a* in the base 27, and these openings can be adjusted in size for example like a shutter. The base 27 is otherwise constructed approximately in the form of a flat disc which extends essentially at right angles to the vertical rotary shaft 18. The openings 27*a* can also be adjusted from the outside if required.

In the embodiment which has just been described the deflecting rotor 16 offers three different possibilities for adjusting the limit and degree of separation, namely by the variable speed, by the adjustment of the baffles 26 (and thus of the openings 17) and by the more or less great opening or closing of the openings in the base 27. The preliminary sifting of the material for grinding can be adapted very well to this readily adjustable further sifting by appropriate adjustment of the guide vanes 15*a* of the ring of guide vanes 15. Furthermore, there is an additional possibility of influence in the lower ring of guide vanes 10 if this is also constructed so as to be appropriately adjustable.

In the left-hand half of the drawing the deflecting rotor 16' is constructed with its outer periphery approximately in the shape of a truncated cone, in which the base of the truncated cone with the smaller diameter faces towards the sifting chamber 14 and the base of the truncated cone with the greater diameter faces the exhaust pipe 23. The baffles 26' which here define the outer peripheral openings 17' in the same way are therefore arranged so that they are inclined downwards. In addition a completely closed base 28 which is constructed in the form of a cone which slopes off towards the outer periphery is provided at the axially lower end of the deflecting rotor 16'. This base 28 which slopes off towards the exterior has proved particularly favourable for roller mill constructions which are used as coal crushers. Naturally in case of need a base in the form of a truncated cone could be provided with openings which are adjustable in size.

Thus the deflecting rotor forms a rotating sifting device by means of which the further sifting effect can be influenced in a number of ways as regards the fineness and degree of separation of the finished material (fine material), and this improved further sifting is assisted by improved preliminary sifting resulting from the adjustability of the ring of guide vanes 15.

Whilst in the illustrated embodiment the deflecting rotor (16, 16') is arranged above the ring of guide vanes (15), it is also possible within the scope of the invention for this deflecting rotor (16, 16') to be arranged at the same height as the ring of guide vanes (15) inside this ring of guide vanes.

What is claimed is:

1. A roller mill comprising a housing having air inlet means at its lower end and air exhaust means at its upper end; a grinding member within said housing; grinding rollers in rotary engagement with said grinding member for comminuting material, said air inlet means and said air exhaust means being operable to establish an upwardly flowing air stream for entraining comminuted material; a conical hopper within said housing defining with the latter an air passage for said air stream and material entrained therein, said hopper forming a sifting chamber inwardly of said air passage having an outlet at its lower end for discharging material to said grinding member, said sifting chamber being in communication at its upper end with said air exhaust means; a ring of guide vanes at the upper end of said sifting chamber, means for deflecting said air stream and material entrained therein from said air passage through said ring of guide vanes transversely inwardly into said sifting chamber to effect a first separation of material entrained in said air stream, said ring of vanes having a diameter corresponding substantially to that of the upper end of said sifting chamber, said housing having an upper sifter portion upwardly converging from a maximum lower transverse diameter inwardly of said ring of guide vanes to an upper air exhaust outlet; a rotor of lesser diameter than that of said ring of vanes and coaxial therewith, said rotor having a bottom and a peripheral wall extending upwardly therefrom and provided with transverse openings therethrough; means mounting said rotor at a level above that of said ring of vanes and between the upper end of said sifting chamber and said air exhaust means; the maximum outer diameter of said rotor being less than the minimum inner diameter of said ring of vanes to provide an annular space therebetween, and the converging upper sifter housing portion extending closely adjacent the upper end of the peripheral wall of said rotor about its circumference, whereby the air stream charged with fine material can be reliably delivered to the outer peripheral openings of said rotor so that all air passing from said sifting chamber flows through the openings of said rotor to effect a second separation of material entrained in said air stream; and drive means for rotating said rotor.

2. Roller mill according to claim 1 wherein said rotor is open at its axially upper end and said bottom is provided with openings.

3. Roller mill according to claim 2 wherein the openings in said base are adjustable in size.

4. Roller mill according to claim 1 wherein said rotor is open at its axially upper end and said bottom is flat.

5. Roller mill according to claim 1 wherein said rotor is open at its axially upper end and said bottom is in the form of a cone which slopes towards the outer periphery.

6. Roller mill according to claim 3 wherein said rotor is of basket-like construction and the openings are evenly distributed over its periphery.

7. Roller mill according to claim 1 wherein the openings of the rotor are defined by baffles arranged at regular intervals around the periphery.

8. Roller mill according to claim 7 wherein the baffles of the rotor are of vane-like construction and are adjustable.

9. Roller mill according to claim 1 wherein said rotor is approximately cylindrical.

10. Roller mill according to claim 1 wherein said rotor is approximately in the shape of a truncated cone, the smaller diameter end of said truncated cone facing the sifting chamber and the larger diameter end of said truncated cone facing the exhaust means.

11. Roller mill according to claim 1 wherein said rotor has a base at its axially lower end and is open at its axially upper end.

12. Roller mill according to claim 1 wherein said drive means comprises a substantially vertical rotary shaft mounted at its upper end in said housing and supported at its lower end in a bearing centered and braced by radial pull rods.

13. Roller mill according to claim 12 wherein said drive means is connected to said rotary shaft.

14. Roller mill according to claim 1 including adjusting means external of said housing for adjusting the guide vanes of said ring of guide vanes.

* * * * *